US008132791B2

(12) United States Patent
Stucker

(10) Patent No.: US 8,132,791 B2
(45) Date of Patent: Mar. 13, 2012

(54) FENCE POST WITH SELECTIVELY COVERED, MOLDED CHANNEL

(76) Inventor: Justin D. Stucker, Kuna, ID (US)

( * ) Notice: Subject to any disclaimer, the term of this patent is extended or adjusted under 35 U.S.C. 154(b) by 320 days.

(21) Appl. No.: 12/364,346

(22) Filed: Feb. 2, 2009

(65) Prior Publication Data

US 2009/0194753 A1 Aug. 6, 2009

Related U.S. Application Data

(60) Provisional application No. 61/025,681, filed on Feb. 1, 2008.

(51) Int. Cl.
*E04H 17/14* (2006.01)

(52) U.S. Cl. ..... 256/19; 256/24; 256/59

(58) Field of Classification Search ..... 256/19, 256/21, 24, 59, 66, 72, 65.02, 65.11
See application file for complete search history.

(56) References Cited

U.S. PATENT DOCUMENTS

| | | | | |
|---|---|---|---|---|
| 3,879,017 | A * | 4/1975 | Maxcy et al. | 256/65.08 |
| 4,026,084 | A * | 5/1977 | Goose | 52/780 |
| 4,047,703 | A * | 9/1977 | Murdock | 256/68 |
| 4,722,514 | A | 2/1988 | Pettit | |
| 4,962,914 | A | 10/1990 | Taylor | |
| 5,651,534 | A * | 7/1997 | Yoder | 256/19 |
| 5,695,174 | A | 12/1997 | Tsai | |
| 5,702,090 | A * | 12/1997 | Edgman | 256/19 |
| 5,803,438 | A | 9/1998 | Blouin | |
| 5,864,997 | A | 2/1999 | Kelly | |
| 2002/0185640 | A1 | 12/2002 | Heins | |
| 2004/0036064 | A1 | 2/2004 | Takagi et al. | |
| 2004/0217339 | A1 * | 11/2004 | Stone | 256/19 |
| 2007/0012904 | A1 * | 1/2007 | Zell et al. | 256/65.06 |
| 2007/0194293 | A1 * | 8/2007 | Edens et al. | 256/19 |

FOREIGN PATENT DOCUMENTS

| | | |
|---|---|---|
| GB | 1391263 | 4/1975 |
| GB | 1404982 | 9/1975 |
| GB | 2259924 | 3/1993 |

* cited by examiner

*Primary Examiner* — Michael P Ferguson
(74) *Attorney, Agent, or Firm* — Robert L. Shaver; Dykas & Shaver, LLP

(57) ABSTRACT

Disclosed is a fence post with selectively covered, molded channels for use in modular fences. The post includes at least one longitudinally-extending channel that is covered by the exterior surface of a side of the fence post in such a way that channel is not visible from the exterior of the fence post until the covering portion of the fence post is cut away, in whole or in part, to make the channel accessible. The channel cover may be removed, in whole or in part, to allow longitudinal ends of pickets to be slid into the channel, either horizontally or vertically according to the selected portion of the channel cover that is removed. In this way, one fence post design may be used to stably support pickets connected on any of the sides of the post while leaving the other sides smooth in external appearance.

13 Claims, 13 Drawing Sheets

FENCE POST WITH SELECTIVELY COVERED, MOLDED CHANNEL

CROSS-REFERENCE TO RELATED APPLICATIONS

This application claims the priority date of the provisional application entitled Fence Post with Covered, Molded Channel filed by Justin D. Stucker on Feb. 1, 2008, with application Ser. No. 61/025,681.

FIELD OF THE INVENTION

The invention relates generally to fence posts used in modular fence installations and more particularly to plastic fence posts with molded channels configured for receiving and supporting plastic pickets.

BACKGROUND OF THE INVENTION

In the field of modular, plastic fences, easy, tool-free installation is preferred. However, systems allowing for easy installation tend to suffer from less-than-ideal stability, particularly at the point where a picket or rail is joined to a fence post. To combat that problem, prior systems have required installation of braces to fence posts, where the braces act to support pickets connected thereto. More recently, systems have been designed that incorporate channels within the sides of the fence post where the channels are designed to receive a portion of a picket therewithin. Such systems, however, have been overly complicated in design, limit the manner in which a picket or rail component may be connected to the fence post, and are designed in such a manner that either one fence post design cannot be used in different rail-to-rail configurations or the fence post falls short in aesthetic pleasantness when installed.

For example, several prior designs that incorporate channels have extensive internal workings, which limit the design and configuration of supports that may be inserted through the fence post when installed. Accordingly, these designs limit the structural support that may be added to the fence post during installation.

Other channel-including fence post designs allow a picket or rail to be installed into the channel of the fence post by sliding the picket or rail, as the case may be, only in a particular direction, such as vertically, from the top of the fence post toward the bottom of the fence post. This makes installation difficult in situations in which the fence is being installed underneath any kind of overhanging matter, such as when a fence is being installed beneath low-hanging branches of a tree. Further, vertically sliding pickets in place in this manner generates unwanted heat due to friction of the pickets contacting the surrounding channels. With the heat and excessive contact, the parts have a tendency to stick in place, making installation of the pickets uncomfortable and troublesome.

Further, prior channel-including fence post designs often sacrifice aesthetic pleasantness for the sake of uniformity. That is, fence posts are needed to support a variety of rail-to-rail (or picket-to-picket) configurations. For example, fence posts are needed both to support portions of fences in which rails and pickets on one side are in a 180 degree relation to the rails and pickets on the other side of the post and to support portions of fences in which rails and pickets on one side are in 90 degree relation to the rails and pickets on the other side of the post. Prior channel-including designs either required different configurations of fence posts depending on how the rails and pickets to be supported were to be aligned or required incorporation of channels on more sides of the fence post than may ultimately be necessary. Thus, someone installing a fence with a corner who wanted clean-looking fence post sides on the sides to which no rail or picket was to be attached would need one fence post with only two channels, each on 90-degree-related sides, and other fence posts with only two channels, each on 180-degree-related sides. Alternatively, someone installing a fence with a corner who wanted to use only one design of fence post would need to use a fence post having channels included on at least three sides such that once the fence was installed, at least one unused channel on each fence post would be visible.

Further, many prior channel-including fence post designs are limited in that the fence posts are not configured to be modified for connection of rails in different configurations after the post is already installed. Thus, to modify an installed fence assembly in which a channeled fence post is at a two-way rail intersection (i.e., where the fence post initially connects two rails in 90-degree relation) so that the fence post will be at a three-way rail intersection (i.e., where a third rail is added in 90-degree relation to one of the already-connected rails), either the fence post had to have included at least three channels at the time the post was first installed or a new three-channeled fence post must be installed in place of the original post. In the former case, the initially-unused channel has detracted from the aesthetic pleasantness of the fence post. In the latter case, the installer has had to incur the cost and trouble of acquiring and installing a new fence post.

DESCRIPTION OF THE PREFERRED EMBODIMENTS

Figure 1:
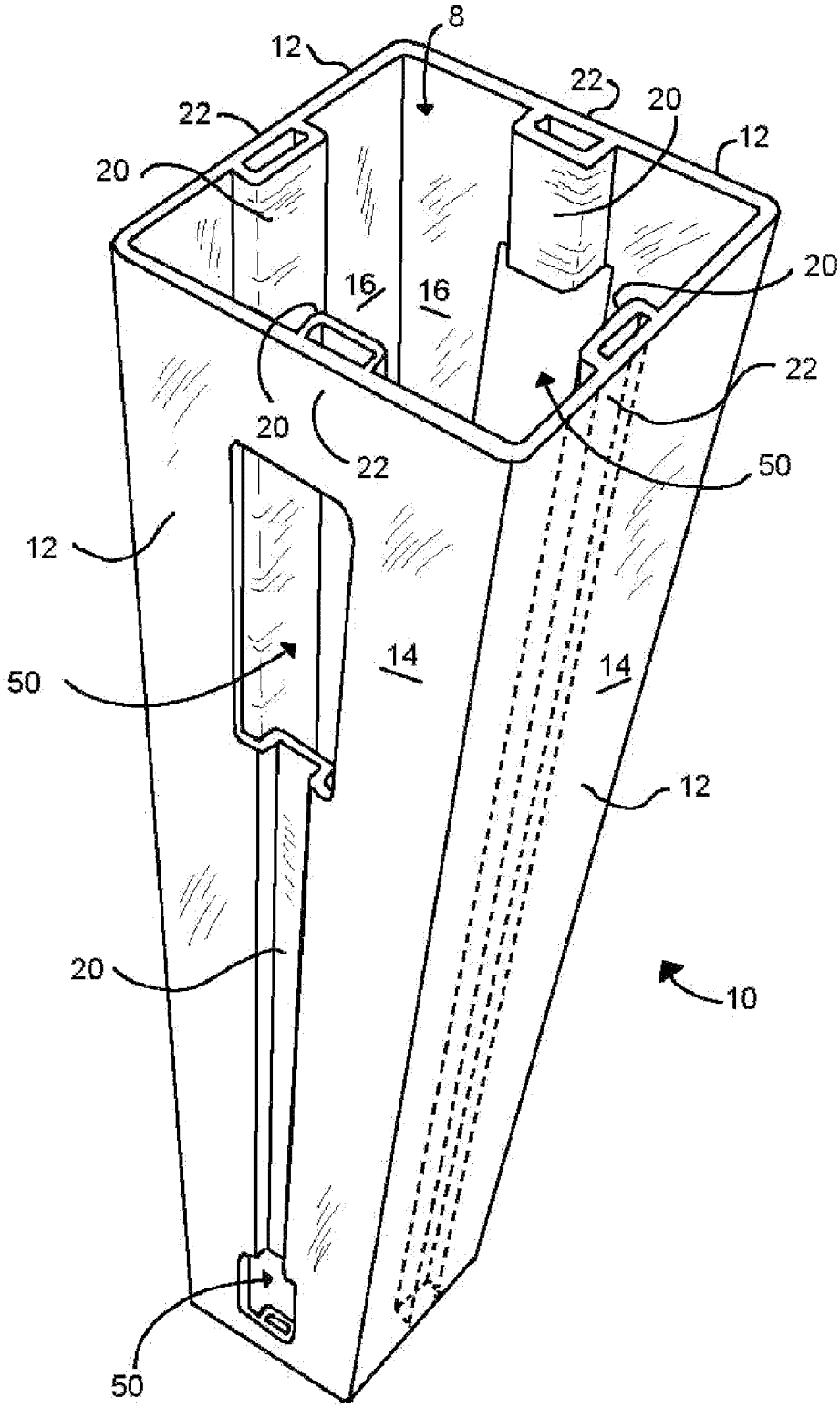
FIG. 1 is a perspective view of the top and sides of a fence post with selectively covered, molded channels according to a first embodiment.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined herein.

In the following description and in the figures, like elements are identified with like reference numerals. The use of "or" indicates a non-exclusive alternative without limitation unless otherwise noted. The use of "including" means "including, but not limited to," unless otherwise noted.

Referring initially to FIG. 1, shown is a first embodiment of a fence post with selectively covered, molded channels. More particularly, shown is a fence post 10 with a plurality of sides 12, each of which has an external surface 14 and an internal surface 16. Attached to the internal surface 16 of each of the sides 12 shown in FIG. 1 is a channel 20 that extends longitudinally along the internal surface 16 of each side 12. Each of the channels 20 is at least initially at least partially covered by a channel cover 22. When at selectively at least partially uncovered, each channel 20 is configured to receive and to essentially substantially support a longitudinal end portion 32 of a picket 30, (shown in FIG. 5).

Figure 3:
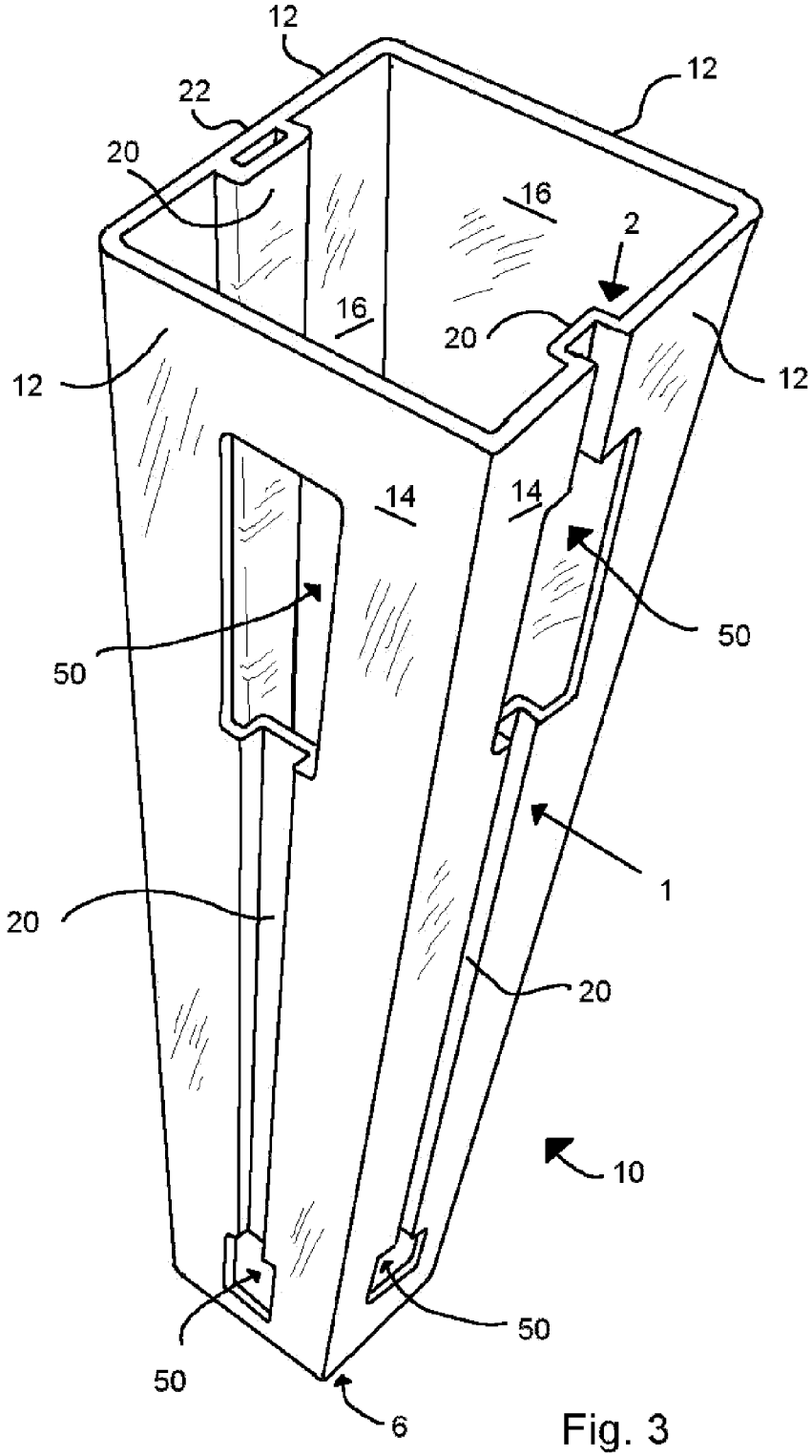
FIG. 3 is a perspective view of the top and sides of a fence post with selectively covered, molded channels according to a third embodiment.

The sides 12 and channels 20 define an interior space 18 (shown in FIG. 6) and a top opening 8 and bottom opening 6 (shown in FIG. 3). The interior space 18 is configured to allow for a support insert (not shown) to be inserted into the fence post 10 via the top opening 8 and to extend down through at least a part of the interior space 18 of the fence post 10 to the bottom opening 6 and possibly into the ground so as to provide additional structural support to the fence post 10 when the fence post 10 is installed in a particular location. Because the interior space 18 of the fence post 10 is defined only by the sides 12 and channels 20, a significant amount of space is available inside the fence post 10 to allow for insertion of support inserts of any of a number of different configurations. Further, in some embodiments, the top opening 8 is configured to receive a top lid 82 (FIG. 13) so as to close off the interior space 18 of the fence post 10 from environmental elements.

According to the preferred embodiment, any or all of the sides 12 of the fence post 10 have fixedly attached thereto a channel 20 that is, at least initially, covered by a channel cover 22. The channel cover 22, prior to being selectively removed, is integrated with the external surface 14 of the side 12 into which it is incorporated so that upon visual inspection of that side 12 of the fence post 10 from outside of the fence post 10, the channel 20 is unseen and the channel cover 22 is visually indistinguishable from the external surface 14 into which it is incorporated. In this way, when the channel cover 22 is in place, the side 12 of the fence post 10 with the in-tact channel cover 22 retains the visual appeal of a fence post that does not have a channel. However, according to the preferred embodiment, the channel cover 22 may be selectively removed, in whole or in part, so as to allow access to any portion of the channel 20 that is behind the channel cover 22. In particular, the channel cover 22 may be selectively removed in any width or length, up to the width and length of the underlying channel 20. Thus, narrow access may be provided to the underlying channel 20 (as in the fifth embodiment shown in FIGS. 9 and 10). Accordingly, the channel cover 22 may be removed in a width that corresponds to the width of the underlying channel 20 so that a picket 30 of corresponding width may be received therein to be essentially stably supported. Alternatively, the channel cover 22 may be removed in a narrow width than that of the underlying channel 20 so that a narrow picket 30 or a lattice 70 may be slideably received within the channel 20 and thereafter essentially securely supported. In either case, once the picket 30 or lattice 70 has been received within the channel 20, the channel 20 acts to essentially stably support the picket 30 or lattice 70 and to minimize or eliminate gaps in the fence assembly between the fence post 10 and the picket 30 or lattice 70, as the case may be.

Also according to the preferred embodiment, one or more of the sides 12 of the fence post 10 define rail-receiving openings 50. Each rail-receiving opening 50 is configured to accommodate insertion of a latitudinal end portion 42 of a rail 40 (shown in FIGS. 4 and 5). The rail-receiving opening 50 is further configured to essentially stably support the latitudinal end portion 42 of the rail 40 after it has been inserted therethrough and into the fence post 10.

According to the embodiment shown in FIG. 1, the front-right and left-back sides 12 of the fence post 10 include channels 20 that are inaccessible from outside the external surface 14 of the sides 12 because the associated channel covers 22 have not yet been selectively removed. Also, according to the embodiment shown in FIG. 1, the front-left and back-right sides 12 of the fence post 10 include channels 20 that are partially accessible from outside the external surface 14 of the sides 12 because the channel covers 22 that were initially in place (not shown) have been partially removed. As such, a longitudinal end portion 32 of pickets 30 may be horizontally slid into the accessible portion of the channels 20 and therein supported essentially stably along the length of the longitudinal end portion 32 of the pickets. In this way, the pickets are held in place and discouraged from bowing inward or outward. The fence post 10 according to the embodiment depicted in FIG. 1 may support two pickets 32 in essentially 180 degree relation to one another.

Also, according to the embodiment depicted in FIG. 1, the front-left and back-right sides define a plurality of rail-receiving openings 50 through which a latitudinal end portion 42 of a rail 40 may be inserted and thereafter essentially stably supported.

Figure 2:
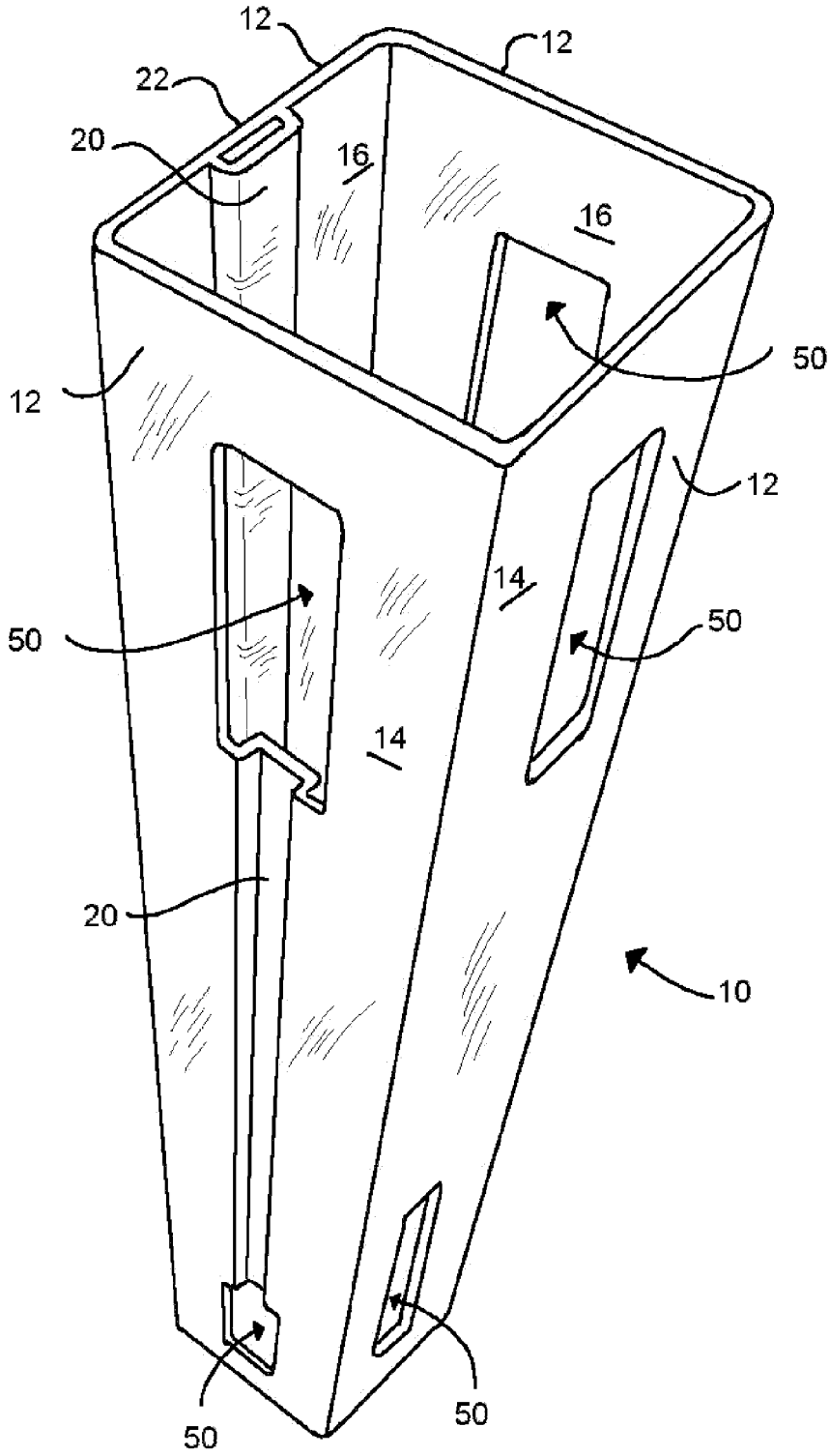
FIG. 2 is a perspective view of the top and sides of a fence post with selectively covered, molded channels according to a second embodiment.

The fence post 10 may also be embodied according to a second embodiment, as shown in FIG. 2. In this second embodiment, the front-left side 12 of the fence post 10 has fixedly attached thereto a channel 20 that extends longitudinally only partway along the middle of the side 12. As shown, the channel cover 22 has already been removed to make accessible the channel 20. The back-left side 12 of the fence post 10 also has fixedly attached thereto a channel 20 that extends longitudinally along the entire length of the side 12. The corresponding channel cover 22 has not yet been removed. However, the front-right and back-right sides do not have attached thereto channels 20. Further, the front-left, front-right, and back-right sides each define a plurality of rail-receiving openings 50, through each of which a lateral end portion 42 of a rail 40 may be inserted and thereafter essentially stably secured.

Shown in FIG. 3 is a third embodiment of the fence post 10, in which three of the sides 12 have channels 20 fixedly attached thereto. One of the sides 12, the front-left side, has such a channel 20 extending longitudinally along only a middle portion of the side 12. Two of the other sides, the front-right side and the back-left side, each include channels 20 extending longitudinally along a greater length of the relative side 12. The channel cover 22 of the back-left side 12 has not been removed, while the channel cover 22 of the front-right side 12 has been completed removed. In this way, the channel 20 of the front-right side 12 may receive therein a longitudinal end portion 32 of a picket 30 in that the longitudinal end portion 32 of the picket 30 may be slid into the channel 20 either horizontally, in the direction depicted by arrow 1, or vertically, in the direction depicted by arrow 2.

Also, according to the embodiment depicted in FIG. 3, the front-left and front-right sides 12 define a plurality of rail-receiving openings 50 configured in the same manner as described above. Accordingly, a fence assembly incorporating the embodiment according to FIG. 3 would allow the fence post 10 to support rails 40 arranged at approximately 90 degrees from one another.

Figure 4:
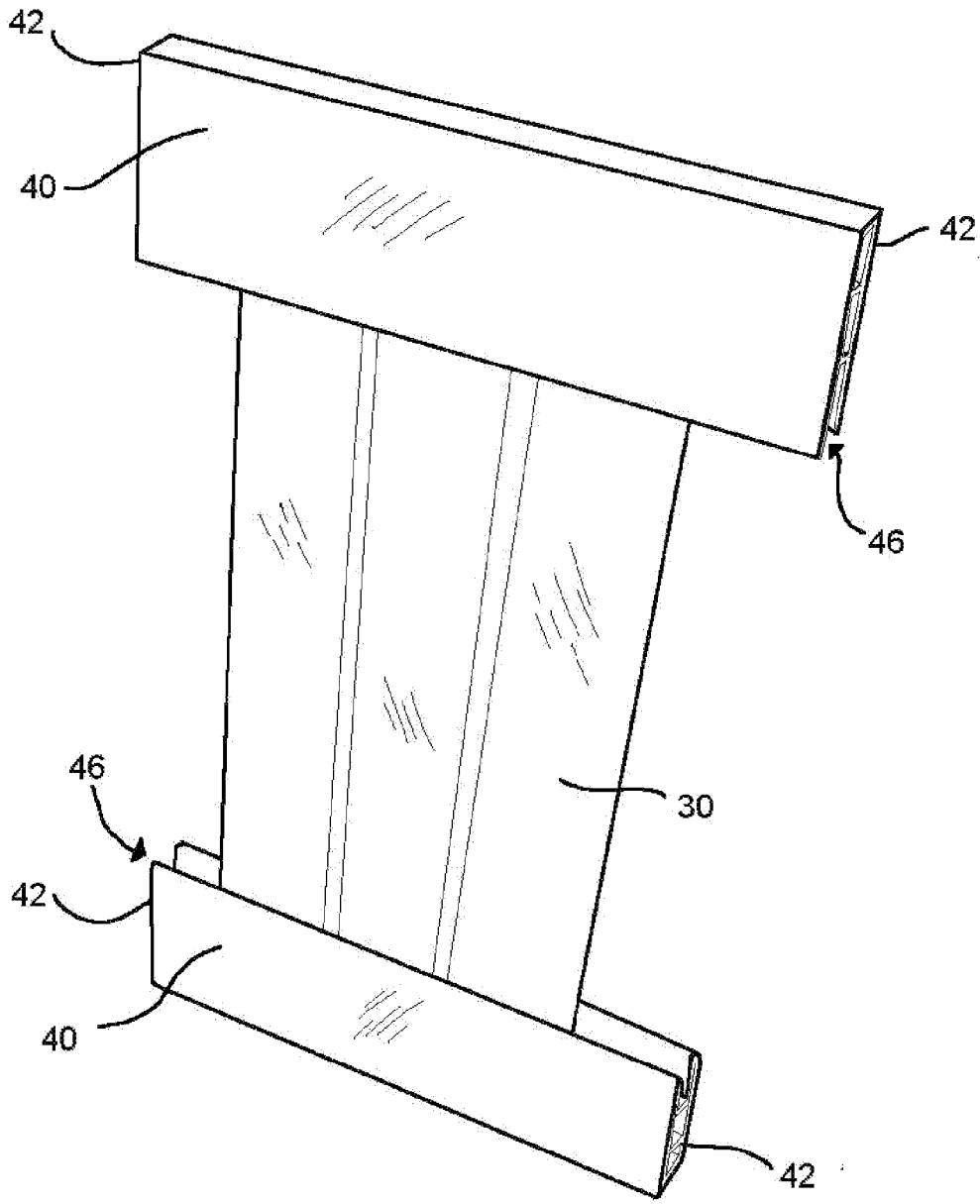
PRIOR ART Fig. 4
FIG. 4 is a perspective view of two known rail components and a known picket component of a fence assembly.

FIG. 4 shows a combination of two rails 40 and a picket 30 in which the picket 30 has been slideably received within the groove 46 of the rail 40. The depicted rails 40 and pickets 30 are known in the art. The entire combination may be horizontally slid into the front-left side 12 of the fence 10 according to the embodiment depicted in FIG. 1, in that the latitudinal end portions 42 of the rails 40 may be horizontally inserted into the rail-receiving openings 50 defined by the front-left side 12 while the longitudinal end portion 32 of the picket 30 may be slid into the accessible portion of the channel 20 since the channel cover 22 has been partially removed as shown. Thereafter, the latitudinal end portions 42 of the rails 40 will be essentially stably supported by the side 12 and the longitudinal end portion 32 of the picket 30 will be essentially stably supported by the channel 20 and discouraged from bowing.

Alternatively, the combination shown in FIG. 4 may be horizontally slid to interconnect with the front-right side 12 of the embodiment depicted in FIG. 2. In this way, the latitudinal end portions 42 of the rails 40 may be inserted into the rail-receiving openings 50 defined by the front-right side 12 so that the latitudinal end portions 42 of the rails 40 will thereafter be essentially stably supported. The longitudinal end portion 32 of the picket 30, however, will remain supported only by the rail 40 in that no channel on the front-right side 12 is available to receive the longitudinal end portion 32 of the picket 30. Thus, the picket 30 will be less discouraged from bowing as in the implementation described in the preceding paragraph.

Figure 5:
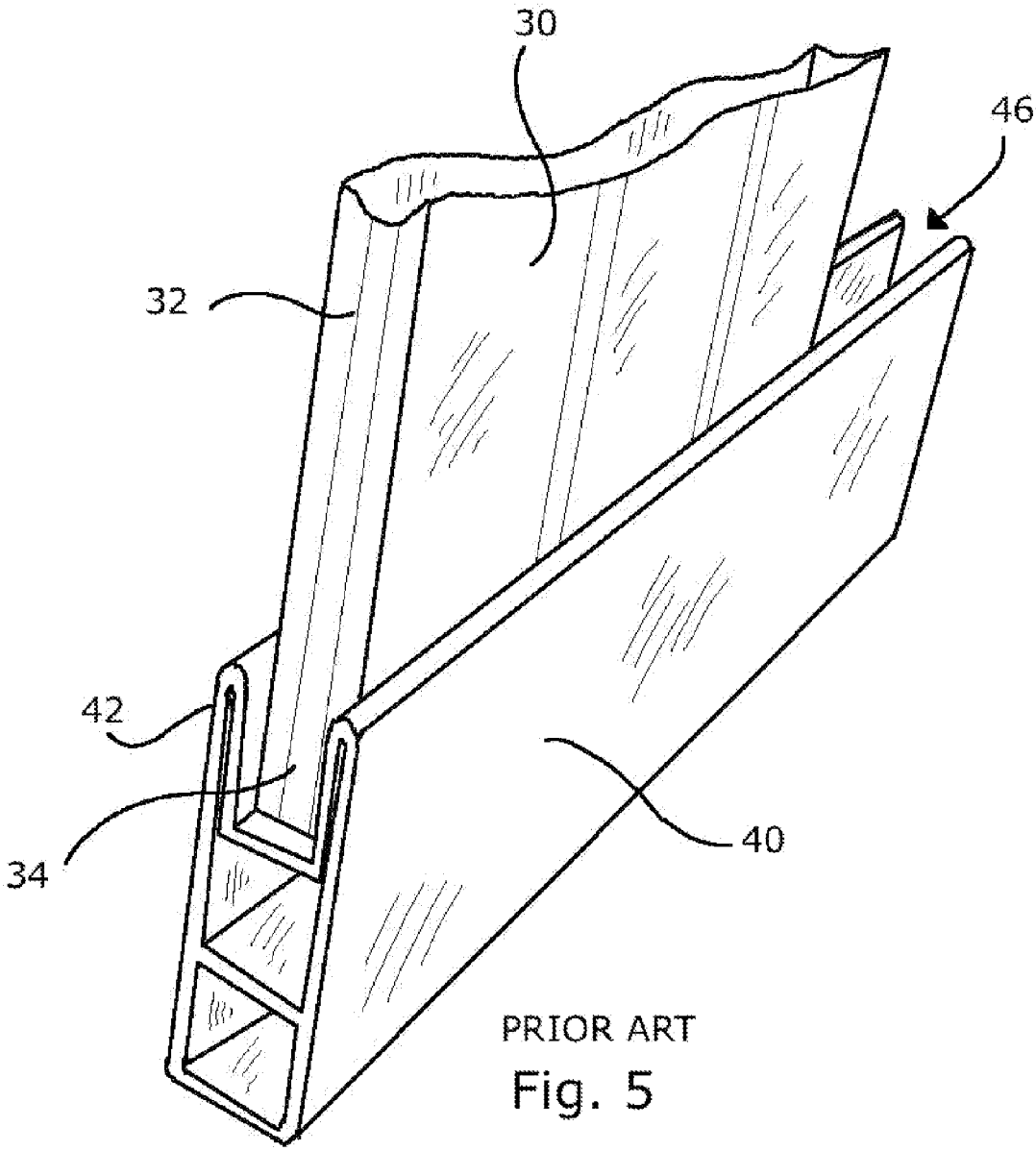
PRIOR ART Fig. 5
FIG. 5 is a partial, perspective view of the known picket component and one known rail component of FIG. 4.

FIG. 5 is a partial enlarged view of the known rail 40 and picket 30 of FIG. 4 in which the rail 40 has a groove 46 in which a latitudinal end portion 34 of a picket 30 has been slideably received.

Figure 6:
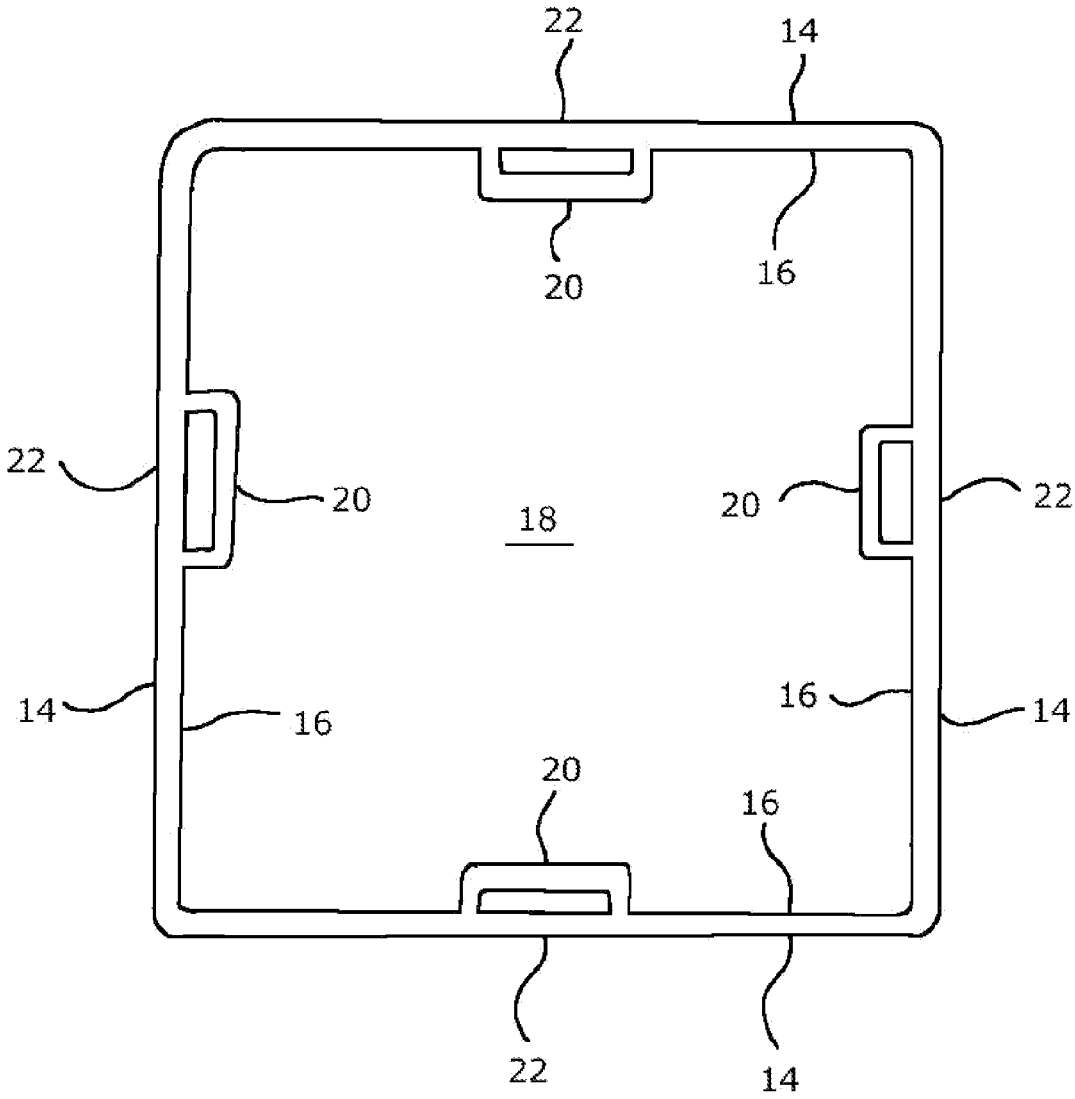
FIG. 6 is a top view of a fence post with selectively covered, molded channels according to the embodiment shown in FIG. 1.
Figure 11:
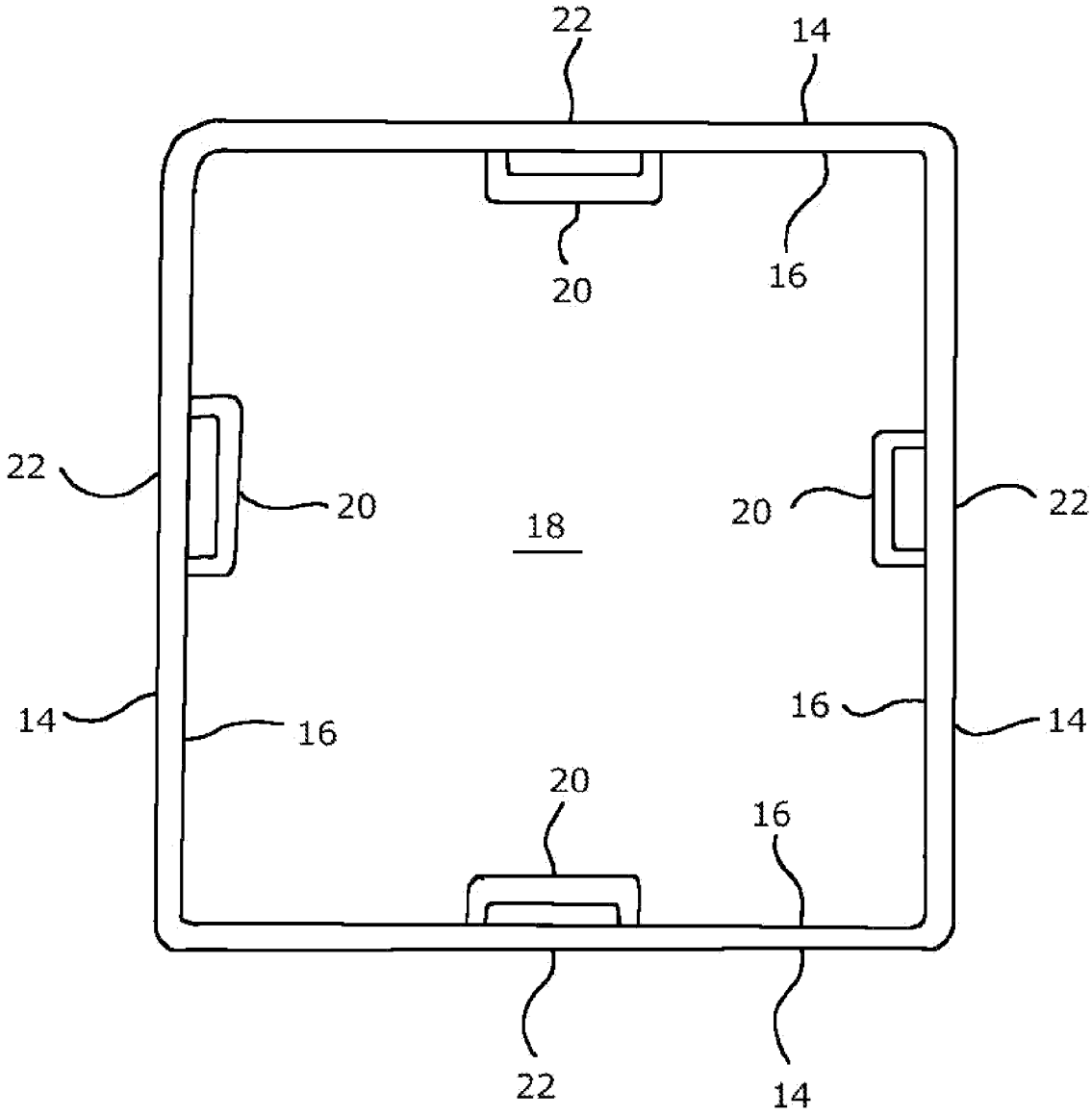
FIG. 11 is a top view of a fence post with selectively covered, molded channels according to a sixth embodiment.

FIG. 6 is a top view of the first embodiment of the fence post with covered, molded channels, i.e., the embodiment depicted in FIG. 1. As shown, the sides 12 and the channels 20 define the interior space 18 of the fence post 10. As shown, the channel covers 22 and channels 20 are integrated with each of the four sides 12. That is, the channels 20 are uniformly joined with the internal surfaces 16. In other embodiments, however, the channels 20 are initially separate and then joined to the internal surfaces 16 (as shown in FIG. 11).

Figure 7:
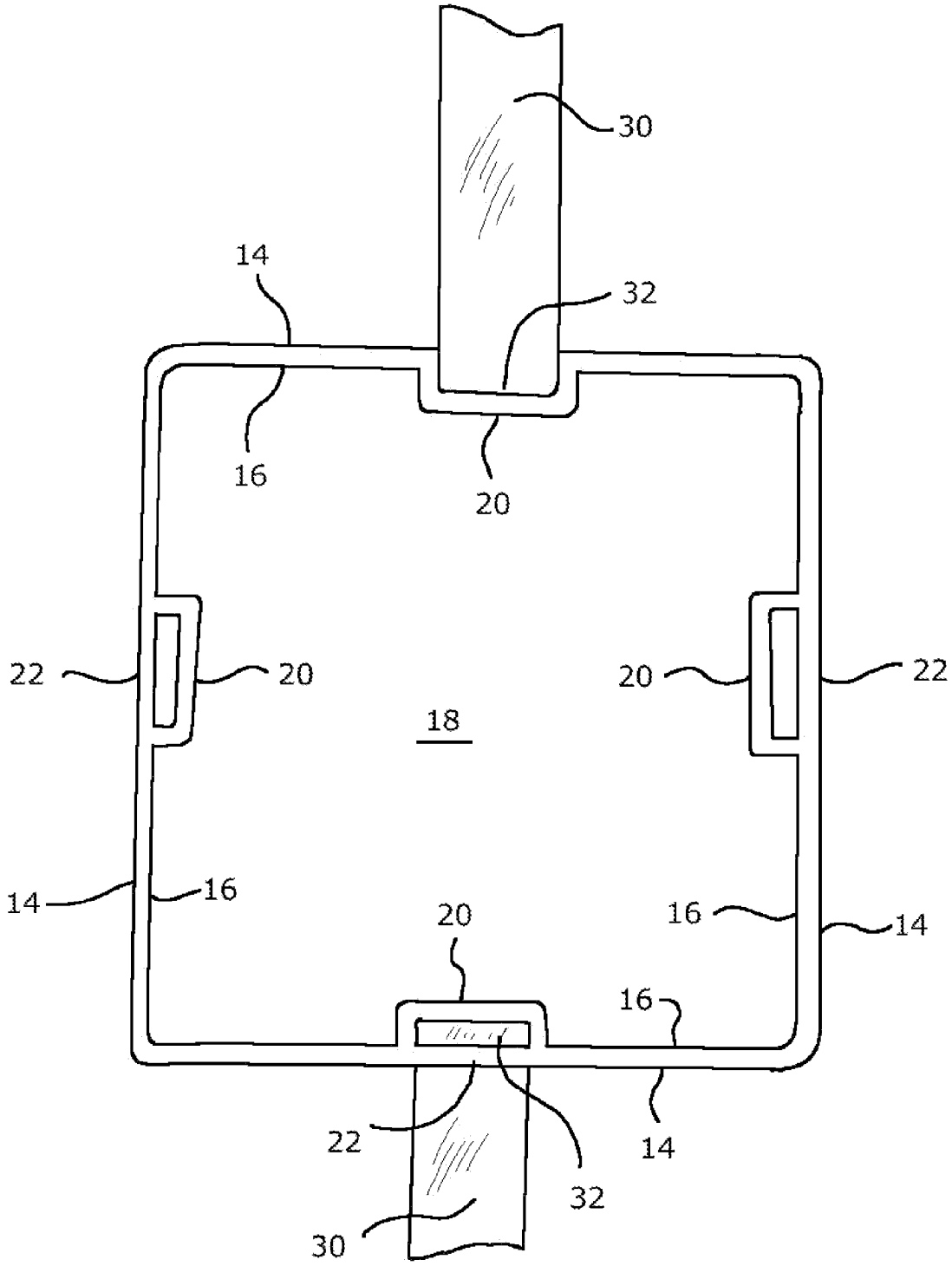
FIG. 7 is a top view of the fence post with selectively covered, molded channels according to a fourth embodiment.

FIG. 7 is a top view of a fourth embodiment in which all channels 20 are fixedly attached to all four sides 12 of the fence post 10. The channel cover of the upper-most-shown side 12 has been removed completely and a longitudinal end portion 32 of a picket 30 received in the accessible channel. The channel cover of the bottom-most-shown side 12 has been removed in part and a longitudinal end portion 32 of a picket 30 received in the accessible channel. Accordingly, from another perspective of the upper-most-shown side with completely-removed channel cover, the upper-most portion of the channel 20 on the top side 12 would be visible to passersby (as with the front-right side shown in FIG. 3). However, from another perspective of the bottom-most-shown side 12 with partially-removed channel cover, the upper-most portion of the channel 20 on the bottom side would remain hidden from view to passers by (as with the front-left side shown in FIG. 1) because that portion remains covered by the channel cover 22. Further, because the upper-most portion of the channel cover 22 of the bottom-most-shown side has not been removed, the longitudinal end portion 32 of the picket 30 may be only horizontally slideably received within the channel 20. On the other hand, because the upper-most portion of the channel cover 22 of the upper-most-shown side has been removed, the longitudinal end portion 32 of the picket 30 may be either horizontally slideably received or vertically slideably received within the channel 20.

Figure 8:
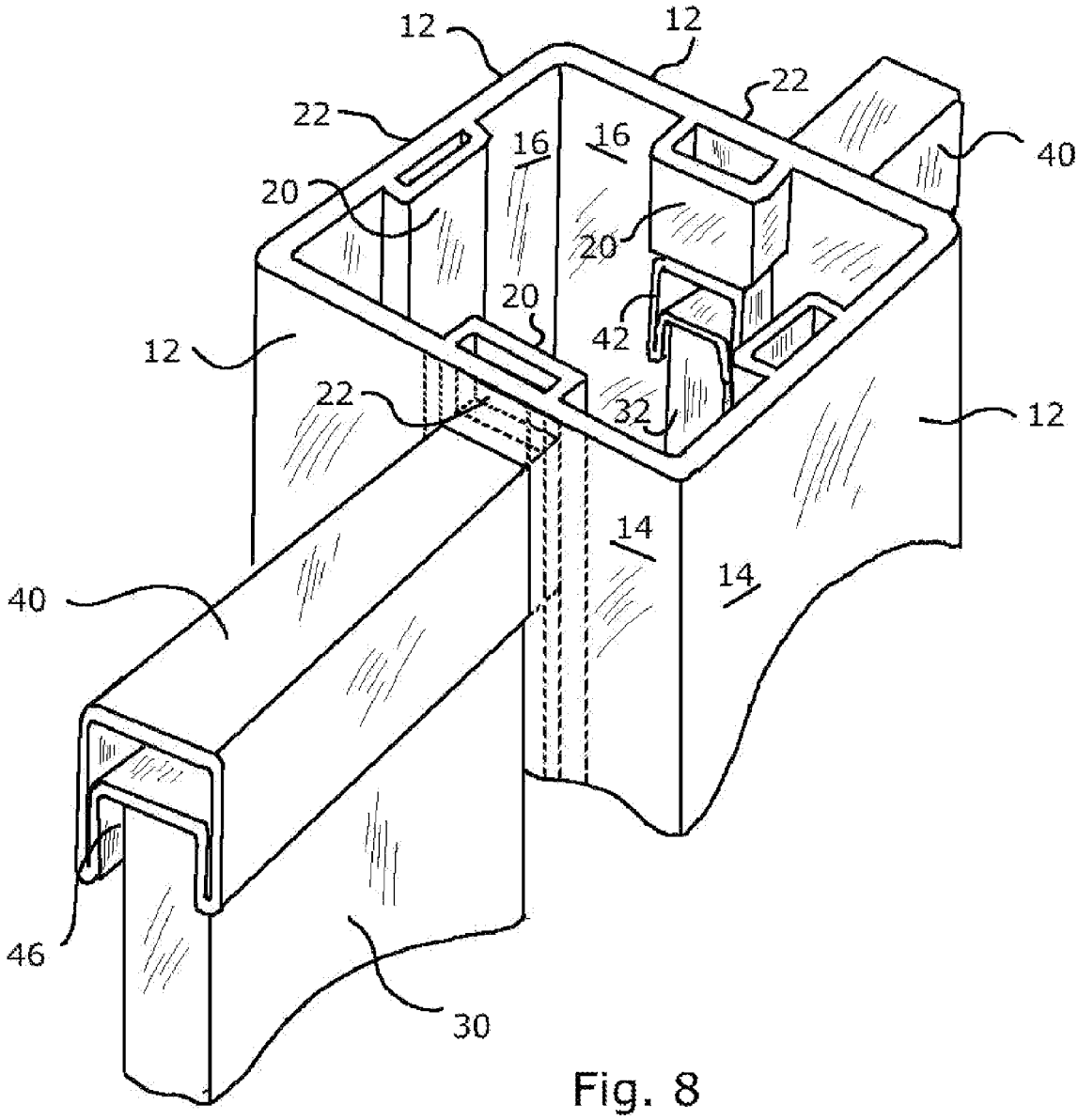
FIG. 8 is a partial, perspective view of a fence assembly incorporating the fence post with selectively covered, molded channels according to the embodiment shown in FIGS. 1 and 6.

FIG. 8 depicts a partial fence assembly including the fence post 10 according to the first embodiment (also shown in FIGS. 1 and 6). In particular, the rail-picket combination as shown in FIGS. 4 and 5 has been connected with the fence post 10 of the first embodiment, i.e., that shown in FIGS. 1 and 6. Specifically, the latitudinal end portions 34 of two pickets 30 have been received within the grooves 46 of two rails 40. A latitudinal end portion 42 of each of the rails 40 has then been inserted into one of each of two rail-receiving openings 50 and a longitudinal end portion 32 of each of the pickets 30 has been horizontally, slideably received into the channels 20, as made accessible by removing channel covers 22 therefrom. As such, the pickets 30 are essentially stably supported on all connected sides in that the longitudinal end portions 32 are essentially stably supported by the channels 20 of the sides 12 of the fence post 10 and the latitudinal end portions 34 are essentially stably supported by the grooves 46 of the rail 40. Further, the latitudinal end portions 42 of the rails 40 are essentially stably supported by the sides 12 of the fence post 10 as well. Thus, the pickets 30 are supported along the entire length of the picket's longitudinal end 32 without the need for installing a separate brace and without the need for nailing or screwing the picket 30 in place. Thereafter, the fence assembly may be easily disassembled without the use of tools.

Figure 9:
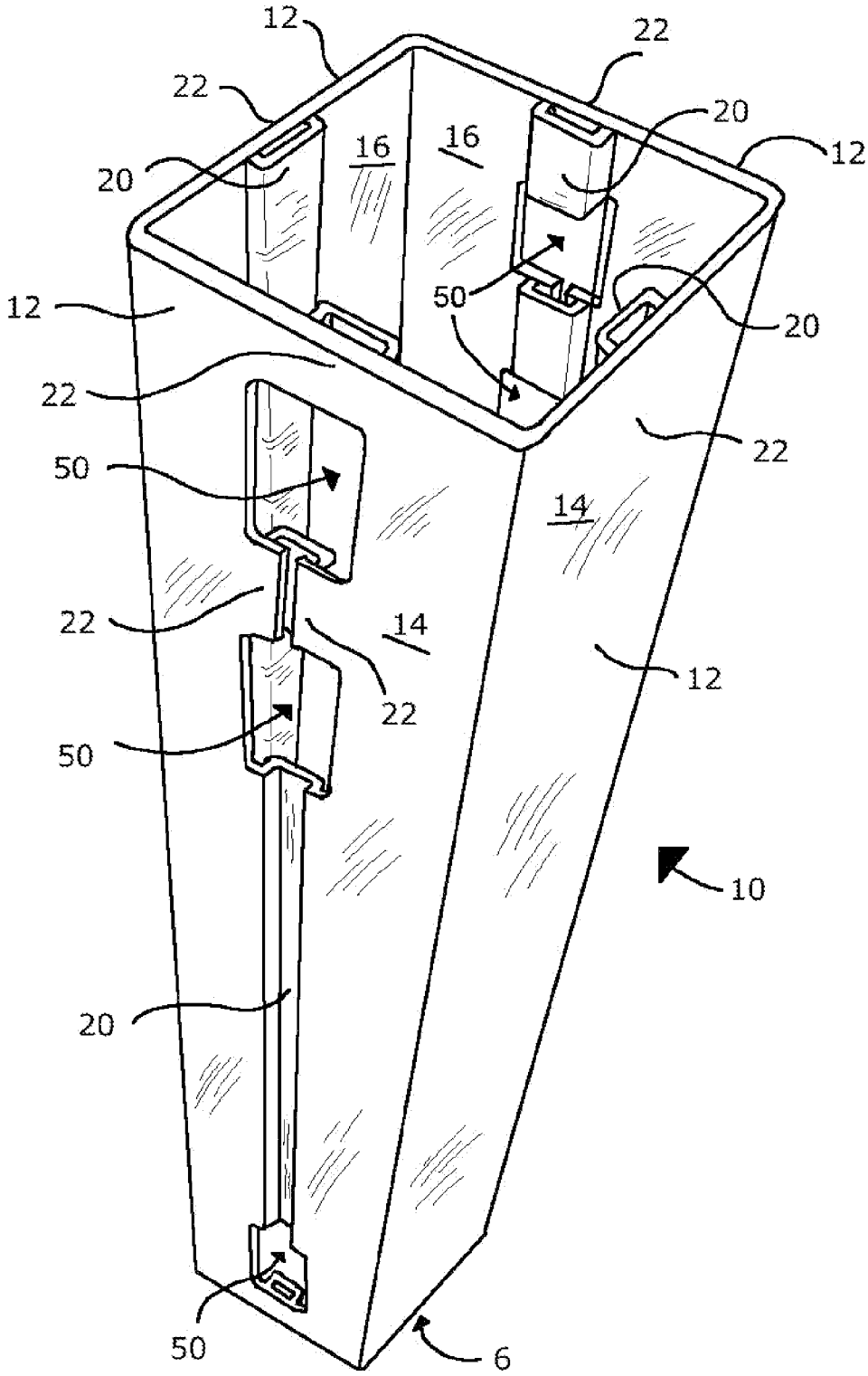
FIG. 9 is a perspective view of a fence post with selectively covered, molded channels according to a fifth embodiment.

FIG. 9 depicts the fence post with selectively covered, molded channels according to a fifth embodiment. As shown, the front-left side 12 of the fence post 10 defines three rail-receiving openings 50. The channel cover 22 between the lowest and middle rail-receiving openings 50 has been removed to the full width of the underlying channel 20 so that the channel 20 is accessible for the longitudinal end portion 32 of a picket 30 to be horizontally, slideably received therein. The channel cover 22 between the middle and upper rail-receiving openings 50 has been removed to only a narrow width, narrower than the width of the underlying channel 20, so that the channel 20 is accessible for the end portion 72 of a lattice 70 or more narrow picket may be horizontally, slideably received therein.

Figure 10:
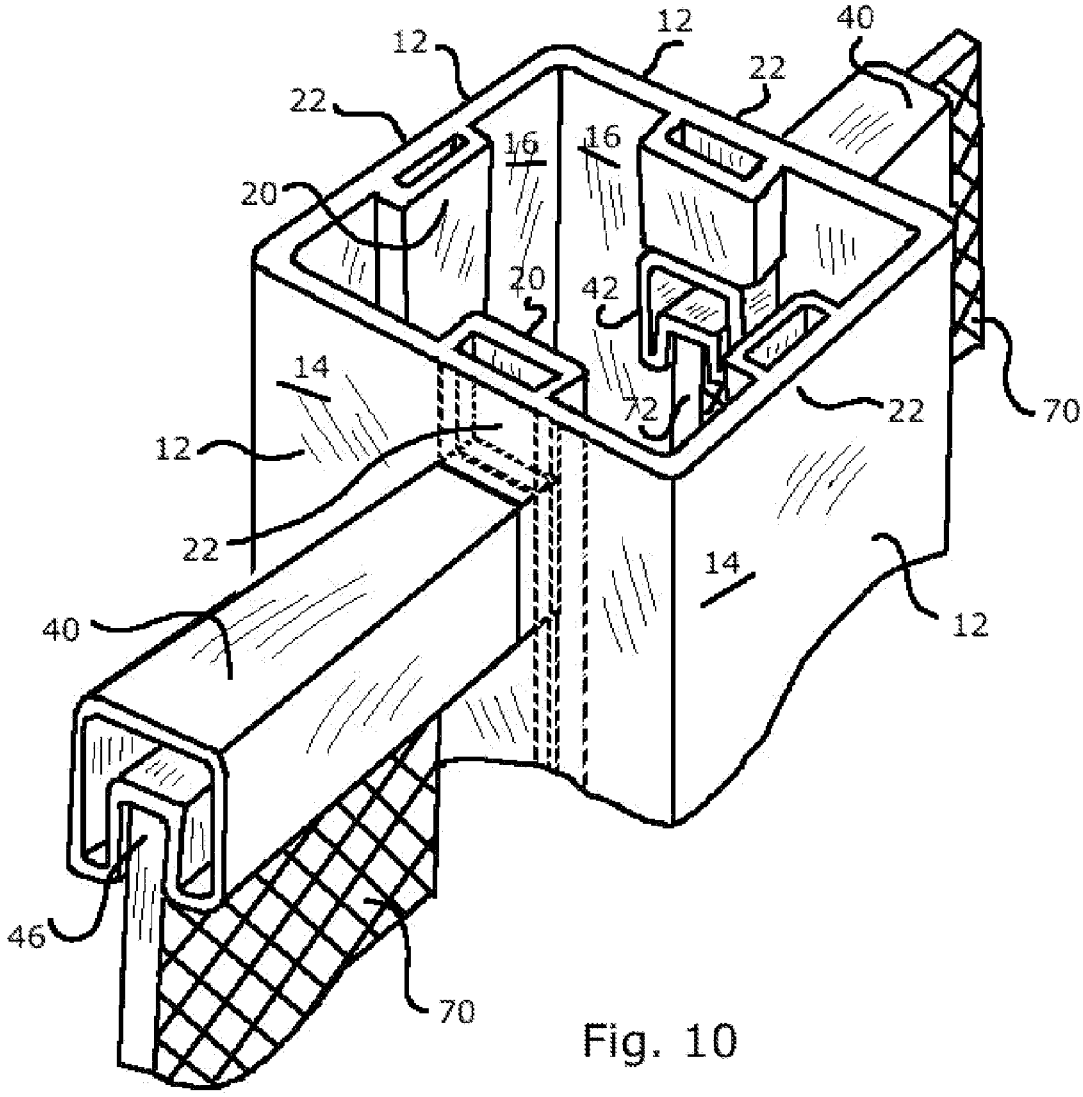
FIG. 10 is a partial perspective view of the top portion of a fence assembly incorporating the fence post with selectively covered, molded channels according to the embodiment shown in FIG. 9.

FIG. 10 depicts the fence post with selectively covered, molded channels according to a modification of the fifth embodiment depicted in FIG. 9. As shown, both the front-left and back-right sides 12 have defined rail-receiving openings 50. The channel covers 22 extending away from the rail-receiving openings 50 have been selectively removed to a narrow width as explained in the previous paragraph. The latitudinal end portion 42 of a rail 40 has been inserted within each of the rail-receiving openings, and the end portion 72 of a lattice 70 has been slideably received within the accessible portion of the channels 20.

FIG. 11 depicts the top of a fence post with selectively covered, molded channels according to a sixth embodiment. According to this embodiment, the channels 20 and the sides 12 are not constructed as one piece. Rather, the channels 20 were initially separate, and then joined to the internal surfaces 16 of the sides 12. Accordingly, unlike the fence post 10 of the first embodiment (shown in FIG. 6), there is a lack of unity between the channels 20, themselves, and the sides 12. In other embodiments, some channels 20 may be unified with the sides 12 while some are initially-separate attachments thereto.

Figure 12:
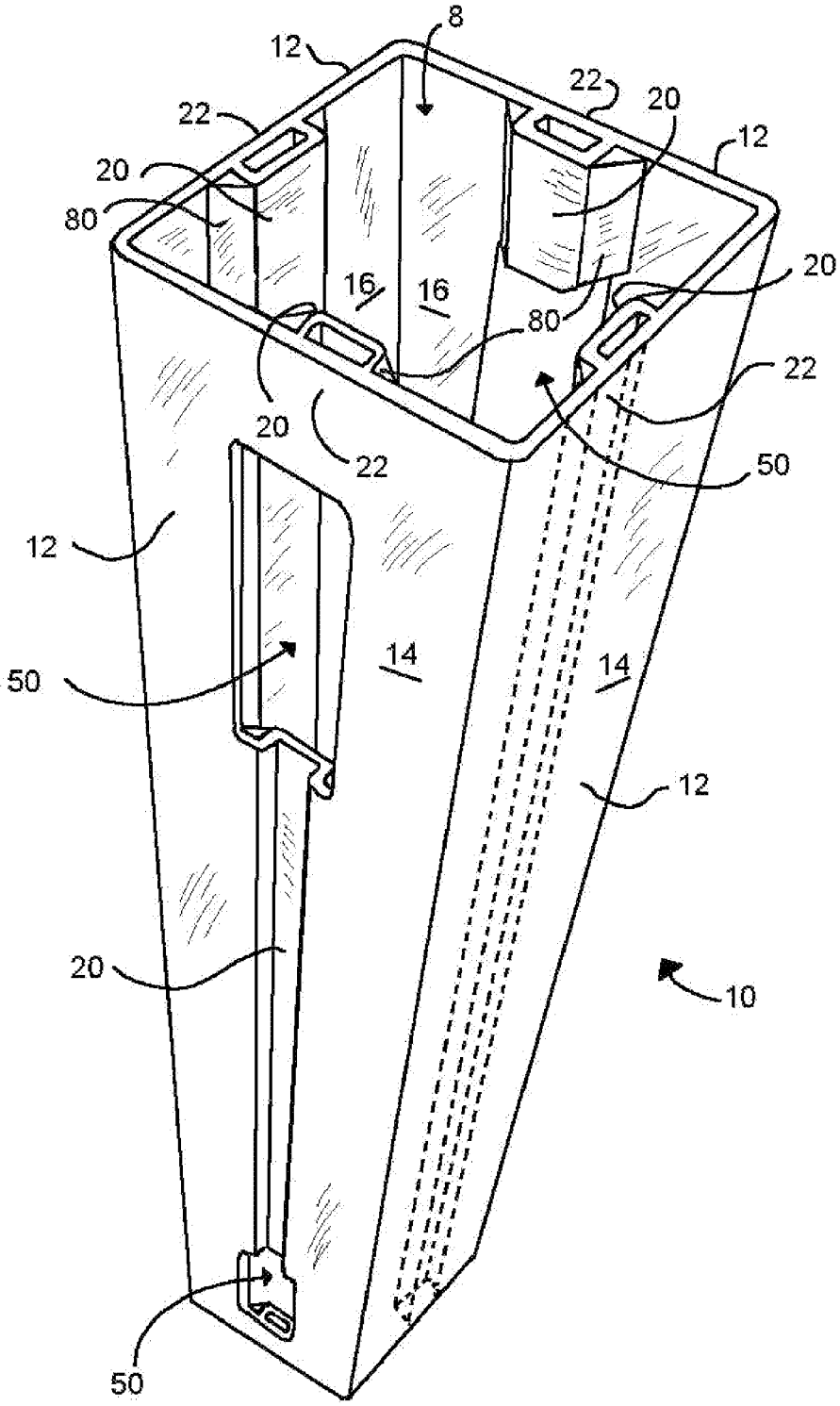
FIG. 12 is a perspective view of the top and sides of a fence post with selectively covered, molded channels according to a seventh embodiment.

FIG. 12 depicts a fence post with selectively covered, molded channels according to a seventh embodiment. The seventh depicted embodiment is much like that shown in FIGS. 1 and 6, but with the addition of gussets 80 on the sides of the channels 20. The gussets 80 provide further structural support to the channels 20. The gusset, which, in this embodiment, comprises a long, three-sided material, is fitted between and attached to the internal surface 16 of a side 12 and the channel 20 that is fixedly attached thereto so as to encourage said internal surface 16 and said channel 20 to remain in a basically 90 degree relation to one another. In other embodiments, the gussets 80 do not extend the entire length of the channels 20, are not included on each and every channel 20 in the post 10, and/or are of a different shape than three-sided.

Figure 13:
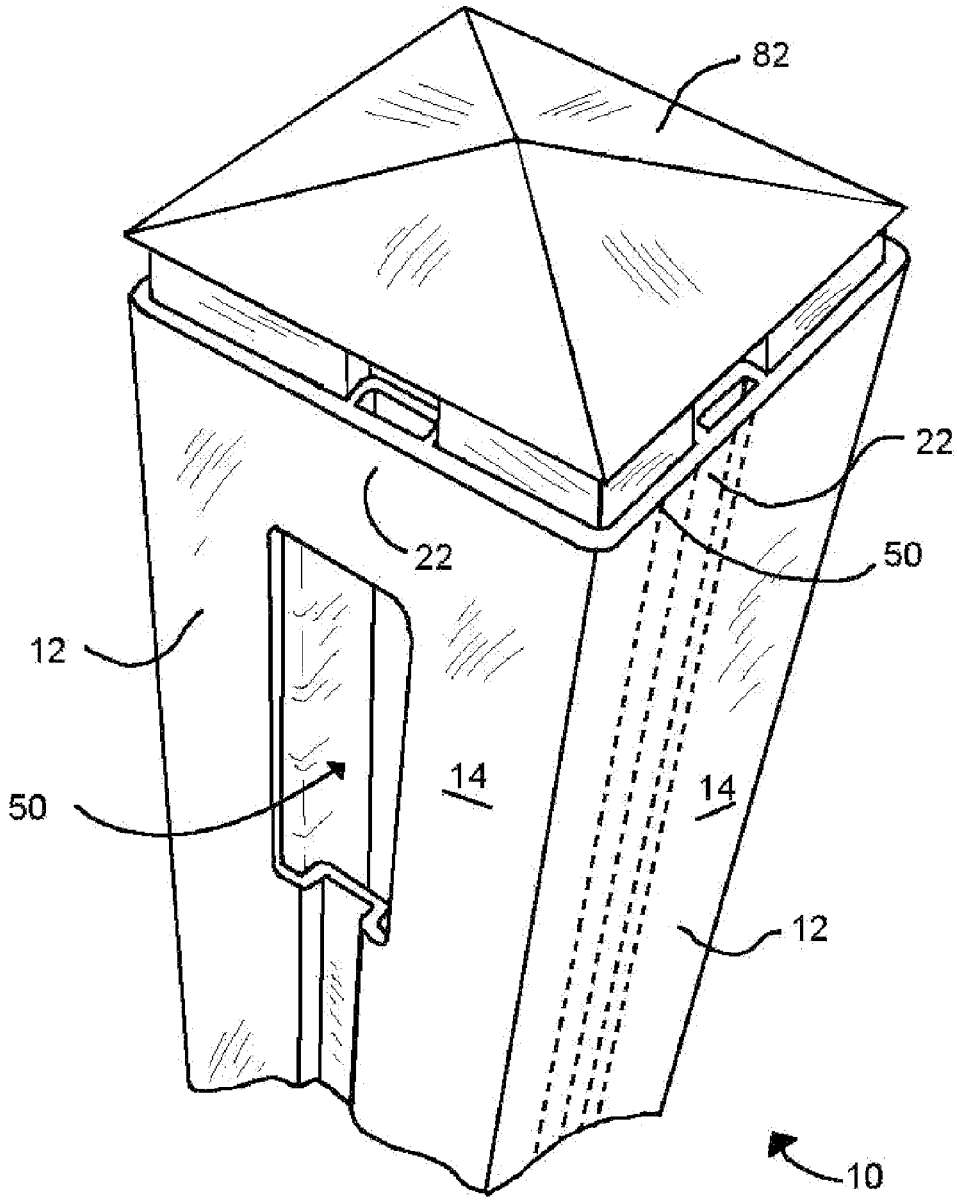
FIG. 13 is a partial, perspective view of the top and sides of a fence post with selectively covered, molded channels according to the first embodiment with a lid partially in place.

FIG. 13 depicts the fence post with selectively covered, molded channels according to the first embodiment (shown in FIGS. 1 and 6), but with a lid 82 raised just slightly above being in place. In other embodiments, the lid 82 may be differently configured but similarly positioned to close the top opening 8.

As shown in the depicted embodiments, it is preferred that the rail-receiving openings 50 defined in each side 12 essentially vertically align with each other. Also, as depicted, it is preferred that the rail-receiving openings 50 defined by a side 12 vertically align with the channel 20 fixedly attached to that side 12.

It is preferred that the fence post 10 be constructed from plastic, such as polyvinyl chloride (PVC) plastic. In this way, the fence post 10 may be extruded and molded essentially as a single piece (as shown in FIG. 6). Thus, it is preferred that the channels 20 are molded channels formed during extrusion of the fence post 10. In this way, they are fixedly attached to the interior surface 16 of the sides 12 of the fence post 10. Thus, the fence post 10 may be constructed entirely from plastic. The channel covers 22 may thereafter be removed, when desired, by cutting away the plastic comprising the channel covers 22.

It should be noted that the number of sides comprising the fence post 10 may be different in other embodiments. Other embodiments may utilize a three-sided, five-sided, or other number of sided post. Further, the number of channels incorporated, whether channels are included on each side, the length of the included channels, the width of the included channels, and the number, orientation, and shape of rail receiving openings may readily vary depending on the desired embodiment. Accordingly, while there is shown and described the present preferred embodiments of the fence post with selectively covered, molded channels, it is to be distinctly understood that this invention is not limited thereto but may be variously embodied to practice within the scope of this disclosure. From the foregoing description, it will be apparent that various changes may be made without departing from the spirit and scope of the invention as defined by this disclosure.

Still other features and advantages of the present fence post with selectively-covered, molded channels will become readily apparent to those skilled in this art from the following detailed description describing preferred embodiments of the fence post, simply by way of illustration of the best mode contemplated by carrying out the fence post. As will be realized, the fence post is capable of modification in various obvious respects all without departing from the invention. Accordingly, the drawings and description of the preferred embodiments are to be regarded as illustrative in nature, and not as restrictive in nature.

What is claimed is:

1. A fence post comprising:

four sides, forming a generally rectangular tube, with each of said sides having an external surface and an internal surface, at least one generally U shaped channel, each of said channels being fixedly attached to and extending essentially longitudinally along a portion of said internal surface of at least one of said sides, each of said channels being configured to receive and to essentially surround on three sides and stably support a longitudinal end portion of a picket, and a channel cover extending essentially longitudinally along said external surface of each of said sides to which a respective said channel is fixedly attached, each of said channel covers being integrated with said external surface along which said channel cover extends such that said channel cover and said external surface are visually indistinguishable, each of said channel covers being selectively removable in whole or in part in any width or length, up to said channel's width and length, so as to allow access to at least a portion of at least one of said channels from outside said fence post;

a plurality of rail receiving openings formed in said at least one side of said fence post on which said generally U shaped channel is present, vertically aligned with said respective channel and configured to receive a picket supporting rail oriented generally normal to said post;

wherein a respective one of said channel cover is selectively removed between said rail receiving openings, so that said longitudinal end portion of a picket can be horizontally, slideably received within said portion of said channel that is accessible from outside said fence post, and wherein when said longitudinal end portion of said picket has been horizontally, slideably received within said portion of said channel, said channel essentially surrounds on three sides and stably supporting said longitudinal end portion and discourages said picket from bowing.

2. The fence post of claim 1, wherein each of said rail-receiving openings is further configured to accommodate insertion of a longitudinal end portion of said picket.

3. The fence post of claim 1, wherein said rail-receiving openings are defined by at least one of said sides so that said rail-receiving openings in said side align essentially vertically with each other.

4. The fence post of claim 1, wherein said fence post is configured to be installed in a location having a ground surface, said sides and said channels define an interior space, said interior space configured to accommodate insertion of at least one support insert within said fence post, said sides of said fence post define a top opening and a bottom opening, said top opening providing access to said interior space, said top opening being configured to allow insertion of at least one of said support inserts through said top opening into said interior space, and at least one of said support inserts being configured so that, once inserted into said interior space through said top opening, said support insert extends longitudinally along a portion of said interior space, through said bottom opening, and into said ground surface so as to provide further structural support to said fence post.

5. The fence post of claim 4, wherein said top opening is further configured to receive a top lid, said top lid configured to close off from environmental elements said interior space of said fence post.

6. The fence post of claim 1, wherein said sides of said fence post define a top opening, said top opening configured to receive a top lid, said top lid configured to close off from environmental elements said interior space of said fence post.

7. The fence post of claim 1, wherein said fence post is constructed from plastic.

8. The fence post of claim 7, wherein said plastic is polyvinyl chloride plastic.

9. The fence post of claim 7, wherein each of said channels is a molded channel.

10. The fence post of claim 7, wherein said fence post is constructed entirely from plastic.

11. The fence post of claim 1, wherein said channel covers are selectively removable in whole or in part in any width or length, up to said channel's width and length, via cutting away portions of said channel covers over said channels.

12. The fence post of claim 1, further comprising a plurality of gussets attached to said internal surface and to said channel and configured to provide support to said channel so as to encourage said channel and said internal surface to remain in basically ninety-degree relation to each other.

13. A fence assembly comprising:

a plurality of pickets, each of said pickets having a longitudinal end portion and a latitudinal end portion;

a plurality of rails, each of said rails having a latitudinal end portion, each of said rails comprising a groove that extends along a side of said rail, said groove configured to slideably receive said latitudinal end portion of at least one of said pickets and to essentially stably support said latitudinal end portion of said picket; and at least one fence post, each said fence post comprising:

four sides, forming a generally rectangular tube, with each of said sides having an external surface and an internal surface, at least one of said sides defining at least two rail-receiving openings, with said rail receiving openings being spaced apart vertically from each other on said fence post side and with each of said rail-receiving openings being configured to accommodate insertion of said latitudinal end portion of a respective one of said rails within said fence post, each of said rail-receiving openings being further configured to essentially stably support said latitudinal end portion of said rail, at least one channel, each of said channels being fixedly attached to and extending essentially longitudinally along a portion of said internal surface of a respective said side of said post on which said rail-receiving openings are positioned, each of said channels being vertically aligned with said rail-receiving openings and configured to receive and to essentially surround on three sides and stably support said longitudinal end portion of a respective one of said pickets, said sides and said channels defining an interior space, said interior space configured to accommodate insertion of at least one support insert within said fence post, and a channel cover extending essentially longitudinally along said external surface of each of said sides to which a respective said channel is fixedly attached, each of said channel covers being integrated with said external surface along which said channel cover extends such that said channel cover and said external surface are visually indistinguishable, each of said channel covers being selectively removable in whole or in part in any width or length, up to said channel's width and length, so as to allow access to at least a portion of at least one of said channels from outside said fence post;

wherein a respective one of said channel covers is removable so as to make accessible at least a portion of at least one of said channels between said rail-receiving openings, for placement of said longitudinal end of said picket in said channel with said channel essentially stably surrounding on three sides and supporting said longitudinal end portion for preventing said picket from bowing, and wherein said latitudinal end portion of at least one of said pickets is slideably receivable within said groove of at least one of said rails, with said latitudinal end portion of said rail inserted within said fence post via one of said at least two rail-receiving openings.

* * * * *